US007132631B2

(12) United States Patent
Nami et al.

(10) Patent No.: US 7,132,631 B2
(45) Date of Patent: Nov. 7, 2006

(54) INDUCTION HEATING FOR IMAGE FLEXING WITH MEANS FOR ADJUSTING MAGNETIC FLUX

(75) Inventors: Yasuo Nami, Toride (JP); Tokihiko Ogura, Kashiwa (JP); Naoyuki Yamamoto, Toride (JP); Takahiro Nakase, Toride (JP); Hitoshi Suzuki, Matsudo (JP); Yasuhiro Yoshimura, Ryugasaki (JP); Toshiharu Kondo, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 78 days.

(21) Appl. No.: 11/016,874

(22) Filed: Dec. 21, 2004

(65) Prior Publication Data

US 2005/0180787 A1 Aug. 18, 2005

(30) Foreign Application Priority Data

Dec. 25, 2003 (JP) ..... 2003-430232

(51) Int. Cl.
*H05B 6/14* (2006.01)
*G03G 15/20* (2006.01)
*H05B 6/68* (2006.01)

(52) U.S. Cl. ..... 219/619; 219/670; 219/667; 399/328; 399/330

(58) Field of Classification Search ..... 219/619, 219/670, 667; 399/328–338
See application file for complete search history.

(56) References Cited

U.S. PATENT DOCUMENTS

| | | | | |
|---|---|---|---|---|
| 5,049,943 | A | 9/1991 | Menjo et al. | 355/284 |
| 5,464,964 | A | 11/1995 | Okuda et al. | 219/497 |
| 5,534,987 | A | 7/1996 | Ohtsuka et al. | 355/285 |
| 5,747,774 | A | 5/1998 | Suzuki et al. | 219/216 |
| 5,994,671 | A | 11/1999 | Suzuki et al. | 219/216 |
| 6,219,522 | B1 | 4/2001 | Ishizuka et al. | 399/333 |
| 6,240,263 | B1 | 5/2001 | Watanabe et al. | 399/69 |
| 6,373,036 | B1 | 4/2002 | Suzuki | 219/619 |
| 6,713,734 | B1 | 3/2004 | Suzuki | 219/619 |
| 6,782,216 | B1 | 8/2004 | Suzuki | 399/69 |
| 2002/0031380 | A1 | 3/2002 | Sato | 399/328 |
| 2002/0158063 | A1 * | 10/2002 | Kawase | 219/619 |
| 2002/0190060 | A1 * | 12/2002 | Imai et al. | 219/619 |

(Continued)

FOREIGN PATENT DOCUMENTS

| | | |
|---|---|---|
| JP | 59-33787 | 2/1984 |

(Continued)

OTHER PUBLICATIONS

European Search Report, issued by the European Patent Office on Aug. 12, 2005, in European Patent Application No. 04030459.4.

*Primary Examiner*—Philip H. Leung
(74) *Attorney, Agent, or Firm*—Fitzpatrick, Cella, Harper & Scinto

(57) ABSTRACT

A heating apparatus of an electromagnetic induction heating type includes a coil and a roller which generates heat by the action of magnetic flux generated from the coil. A recording material is heated by the roller. The heating apparatus further includes a movable magnetic flux decreasing member for decreasing magnetic flux, generated from the coil, acting on the roller. In the heating apparatus, a shutter is moved toward an effective position at which a temperature in a non-conveyance area is lowered when a recording material having a size lower than a maximum conveyable size is conveyed, and is moved away from the effective position depending on the temperature in the non-conveyance area, irrespective of the size of the recording material to be conveyed.

7 Claims, 6 Drawing Sheets

U.S. PATENT DOCUMENTS

| | | | | |
|---|---|---|---|---|
| 2003/0077093 | A1 | 4/2003 | Sekiguchi | 399/328 |
| 2004/0114952 | A1 | 6/2004 | Yamamoto | 399/69 |
| 2004/0129697 | A1 | 7/2004 | Suzuki | 219/619 |
| 2005/0006378 | A1 | 1/2005 | Suzuki | 219/619 |

FOREIGN PATENT DOCUMENTS

| | | |
|---|---|---|
| JP | 61-11776 | 1/1986 |
| JP | 2003-123957 | 4/2003 |

* cited by examiner

INDUCTION HEATING FOR IMAGE FLEXING WITH MEANS FOR ADJUSTING MAGNETIC FLUX

FIELD OF THE INVENTION AND RELATED ART

The present invention relates to a heating apparatus for heating an image on a material to be subjected to fixation. For example, the present invention relates to an electromagnetic induction heating type heating apparatus suitable for a fixing apparatus for heat-fixing an unfixed toner image, which is heat-fusible and is formed and borne on a recording material directly or through transfer, in an electrophotographic type or electrostatic recording type image forming apparatus, such as a printer or a copying machine.

Heretofore, as a heating apparatus, Japanese Laid-Open Patent Application (JP-A) No. Sho 59-33787 has proposed an induction heating type fixing apparatus which utilizes high-frequency induction heating as a heat source. In this fixing apparatus, a coil is disposed concentrically in hollow fixation roller comprising a metal conductor. A high-frequency current is passed through the coil to generate a high-frequency magnetic field. The magnetic field generates an induction eddy current, whereby the fixing apparatus itself generates Joule heat due to its own skin resistance. According to the electromagnetic induction heating-type fixing apparatus, an electricity-heat conversion efficiency is significantly improved, so that it becomes possible to reduce a warm-up time.

However, such an electromagnetic induction heating-type fixing apparatus is actuated so that the entire maximum sheet-passing area is heated at a fixing temperature to perform fixation. For this reason, energy higher than that required for actual toner fixation has been consumed. Further, with respect to a recording material of some sizes, an area other than the sheet-passing area of the fixation roller has been abnormally heated (end portion temperature rise or non-sheet passing portion temperature rise) to cause inside temperature rise or heat deterioration of an apparatus-constituting member such as a fixation roller as a heating member.

In order to solve these problems, e.g., as described in JP-A No. 2003-123957, it is effective to use a magnetic flux blocking means. The magnetic flux blocking means is used to interpose and move a magnetic flux blocking plate between a fixation roller portion and a magnetic flux generating means so that magnetic flux generated by the magnetic flux generating means does not act on the fixation roller portion corresponding to the generation area of the non-sheet passing portion temperature rise. The magnetic flux blocking means judges whether a recording material has a small size or not on the basis of the size of the recording material or a temperature detection result of a non-sheet detecting the size of the recording material. In the case of the small-sized recording material, the magnetic flux blocking plate (shutter) is inserted between the fixation roller portion and the magnetic flux generating means to suppress the abnormal temperature rise at the non-sheet passing portion (end portion) of the fixation roller.

However, in the case of continuously passing the small-sized recording material, when the shutter (the magnetic flux blocking plate) is left, the magnetic flux cannot act on the fixation roller portion, thus excessively lower the temperature in the non-sheet passing area. For this reason, when a subsequent recording material having a large size is passed through the fixation roller, problems such as low-temperature offset, wheel wrinkle caused due to a large temperature gradient, and image failure arise.

Further, it is also possible that a sheet-passing interval is increased depending on the size of a subsequent recording material to wait temperature restoration. However, in the case where the recording material has different sizes, it has been found that a standby time becomes long to considerably impair usability.

SUMMARY OF THE INVENTION

An object of the present invention is to provide an electromagnetic induction heating the heating apparatus which has solved the above-described problems such that when a magnetic flux decreasing means is used, a temperature of a heating element becomes lower than a predetermined temperature to cause heating failure.

According to an aspect of the present invention is to provide a heating apparatus, comprising:

a coil, a heating element which generates heat by magnetic flux generated from the coil and heats an image on a material to be heated, and a movable magnetic flux decreasing member for decreasing a part of the magnetic flux generated from the coil, acting on the heating element, the magnetic flux decreasing member being movable to an effective position at which a temperature in a non-conveyance area is lowered when a material, to be heated, having a size smaller than a maximum conveyable size thereof is conveyed, wherein the magnetic flux decreasing member is moved away from the effective position depending on the temperature in the non-conveyance area.

This and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENT (First Embodiment)

(1) Embodiment of Image Forming Apparatus

Figure 1:
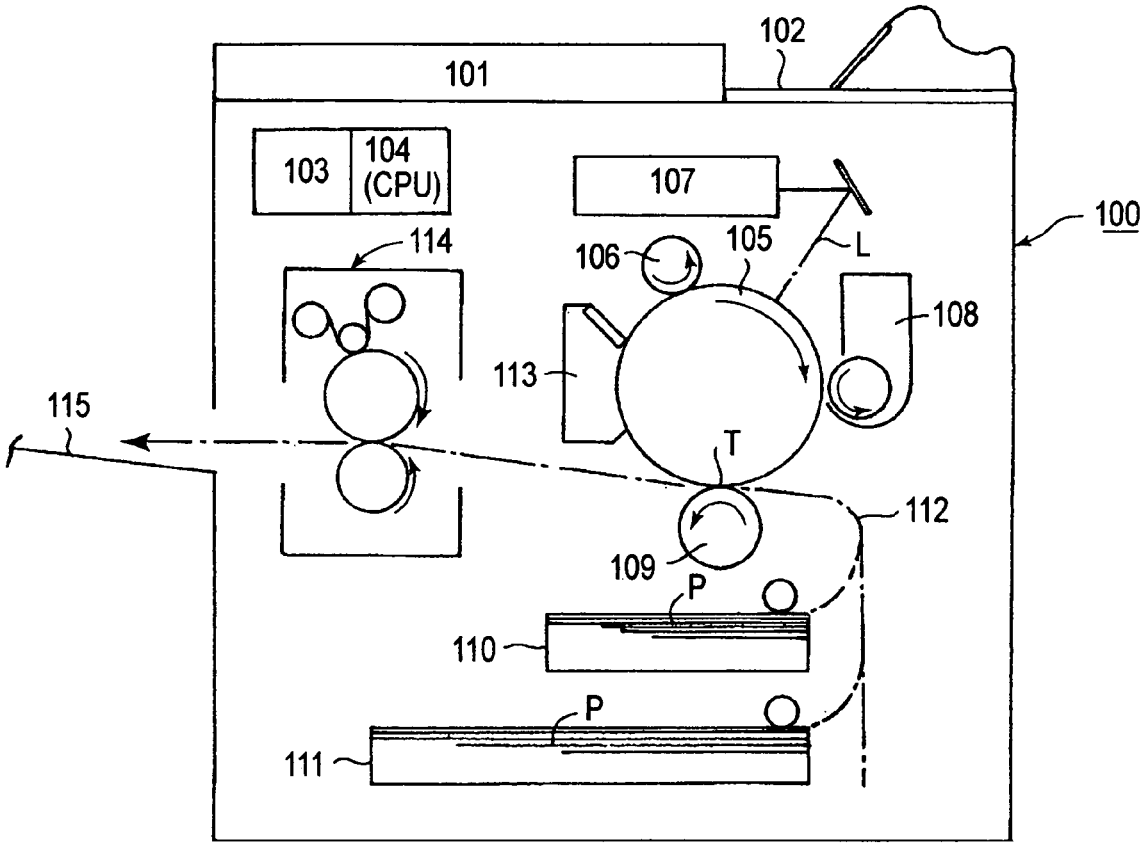
FIG. 1 is a schematic structural view of an embodiment of an image forming apparatus used in First Embodiment.

FIG. 1 is a schematic structural view of an embodiment of an image forming apparatus provided, as an image heat-fixing apparatus 114 with a heating apparatus of an electromagnetic induction heating type according to the present invention.

In this embodiment, an image forming apparatus 100 is a laser scanning exposure-type digital image forming apparatus (a copying machine, a printer, a facsimile machine, a multi-functional machine of these machines, etc.) utilizing a transfer-type electrophotographic process.

On an upper surface side of the image forming apparatus 100, an original reading apparatus (image scanner) 101 and an area designating apparatus (digitizer) 102 are disposed. The original reading apparatus 101 scans a surface of an original placed on a original supporting late of the apparatus with a scanning illumination optical system including a light source and others disposed inside the apparatus, and reads reflected light from the original surface with a photosensor, such as a CCD line sensor, to convert image information into a time-series electric digital pixel signal. The area designating apparatus 102 effects setting of, e.g., a reading area of the original to output a signal. A printer controller 103 outputs a print signal based on image data of an unshown personal computer etc. A controller (CPU) 104 receives the signals from the original reading apparatus 101, the area designating apparatus 102, the printer controller 103, etc., and executes signal processing for sending directions to respective portions of an image output mechanism and image forming sequence control.

In the image output mechanism, a rotary drum-type electrophotographic photosensitive member (hereinafter referred to as a "photosensitive drum") 105 as an image bearing member is rotationally driven in a clockwise direction of an indicated arrow at a predetermined peripheral speed. During the rotation, the photosensitive drum 105 is uniformly charged electrically to a predetermined polarity and a predetermined potential by a charging apparatus 106. The uniformly charged surface of the photosensitive drum 105 is exposed imagewise to light L by an image writing apparatus 107 to be reduced in potential at an exposure light part, whereby an electrostatic latent image corresponding to an exposure pattern on the surface of the photosensitive drum 105. The image writing apparatus 107 used in this embodiment is a laser scanner and outputs laser light L modulated according to image data signal-processed in the controller (CPU) 104 to scan, for exposure, the uniformly charged surface of the rotating photosensitive drum 105, thus forming an electrostatic latent image corresponding to the original image information.

Next, the electrostatic latent image is developed as a toner image with toner by a developing apparatus 108. The toner image is electrostatically transferred from the surface of the photosensitive drum 105 onto a recording material (transfer material) P, as a recording medium, which has been supplied to a transfer portion T, of a transfer charging apparatus 109, opposite to the photosensitive drum 105 from a sheet (recording material) supply mechanism portion at predetermined timing.

The sheet supply mechanism portion of the image forming apparatus of this embodiment includes a first sheet supply cassette portion 110 accommodating a small-sized recording material, a second sheet supply cassette portion 111 accommodating a large-sized recording material, and a recording material conveying path 112 for conveying the recording material P which has been selectively fed from the first or second sheet supply cassette portion on one sheet basis to the transfer portion T at predetermined timing.

The recording material P onto which the toner image has been transferred from the photosensitive drum 105 surface at the transfer portion is separated from the photosensitive drum 105 surface and conveyed to a fixing apparatus 114 by which an unfixed toner image is fixed on the recording material P, which is then discharged on an output tray 115 located outside the image forming apparatus.

On the other hand, the surface of the photosensitive drum 105 after the separation of the recording material P is cleaned by a cleaning apparatus 113 so as to remove residual toner remaining on the photosensitive drum 105. The photosensitive drum 105 is then repetitively subjected to image formation.

(2) Fixing Apparatus 114.

Figure 2:
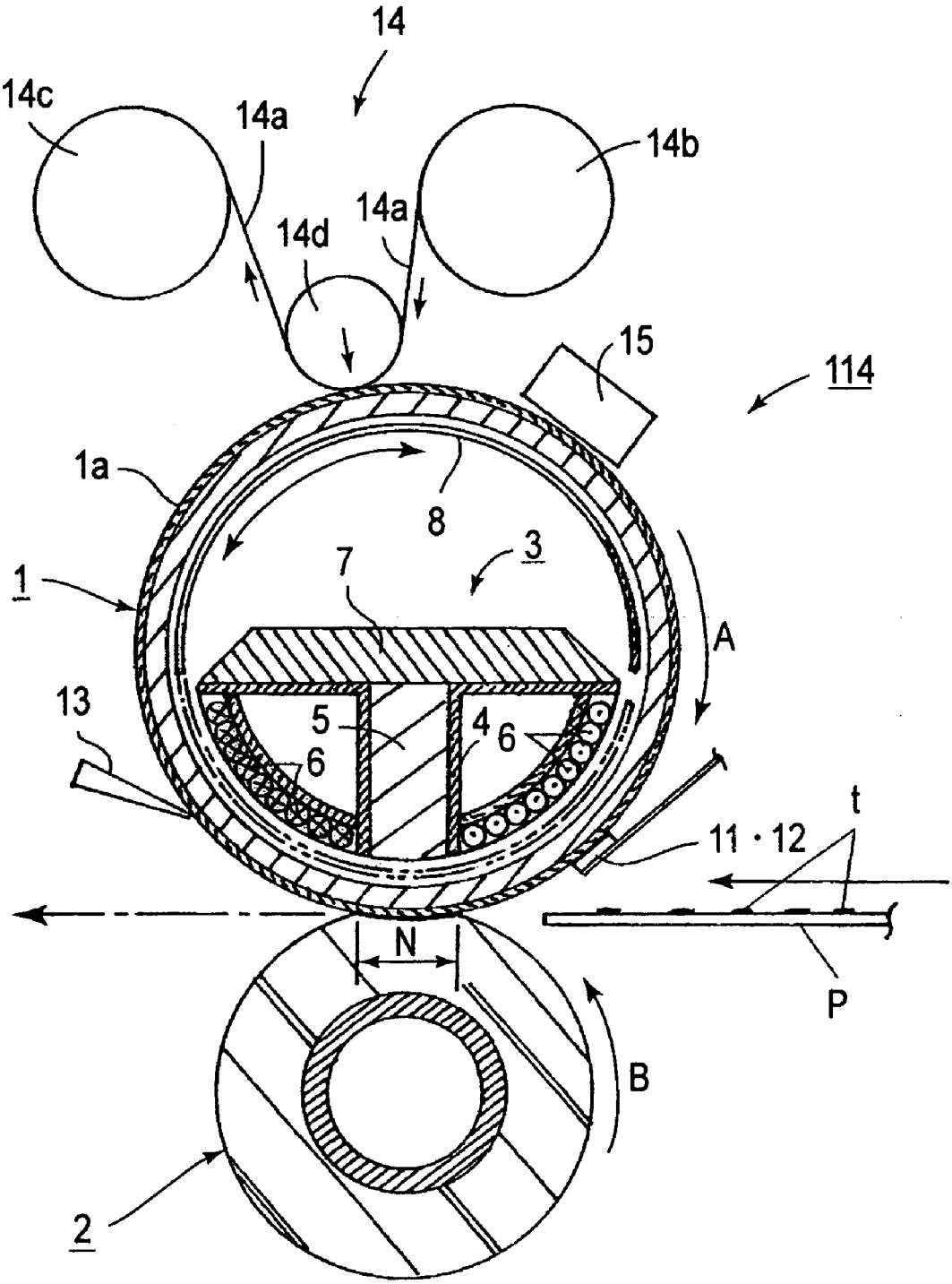
FIG. 2 is an enlarged cross-sectional view of a principal part of an image heat-fixing apparatus used in First Embodiment.
Figure 3:
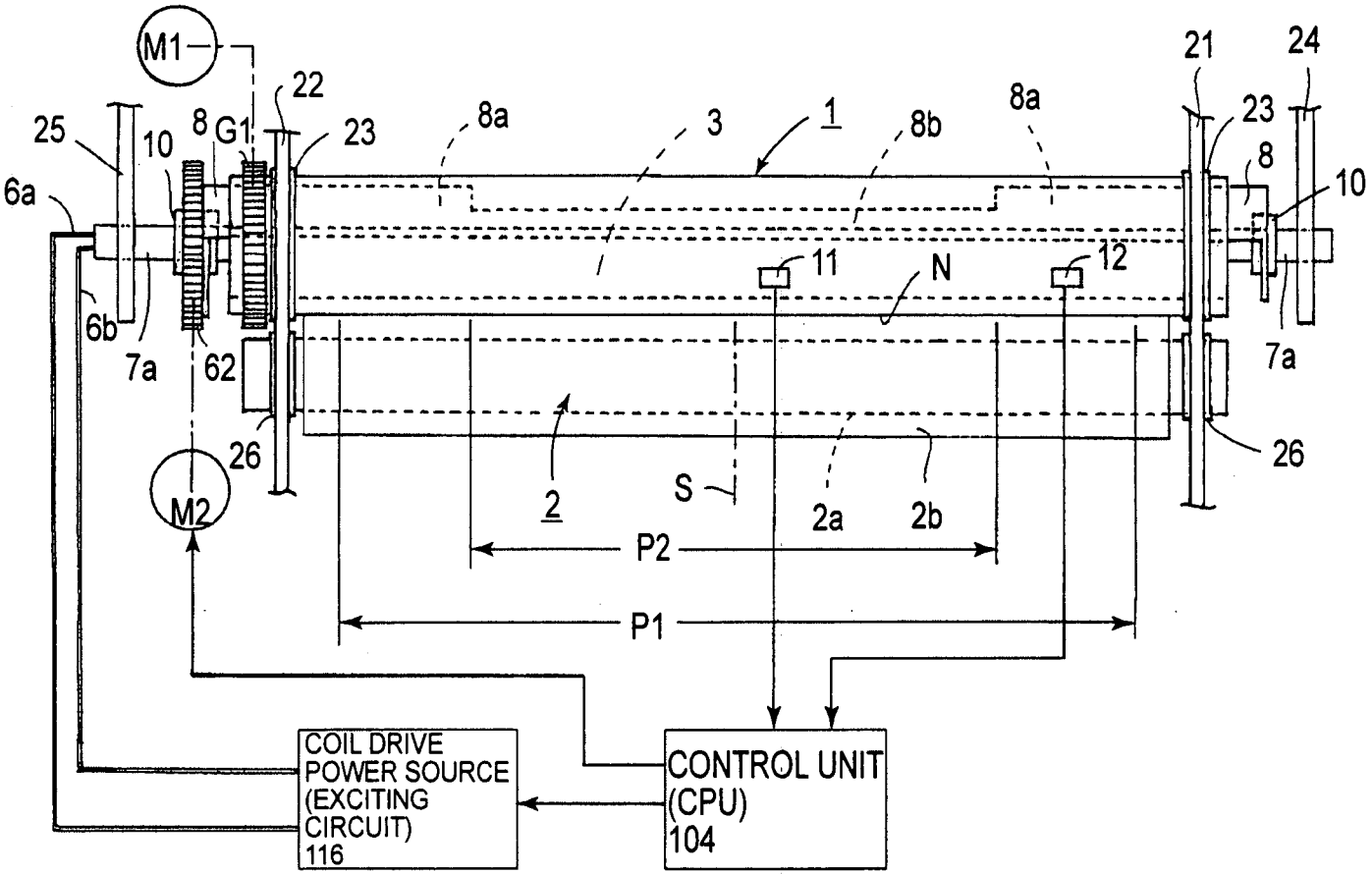
FIG. 3 is a schematic front view of the principal part.
Figure 4:
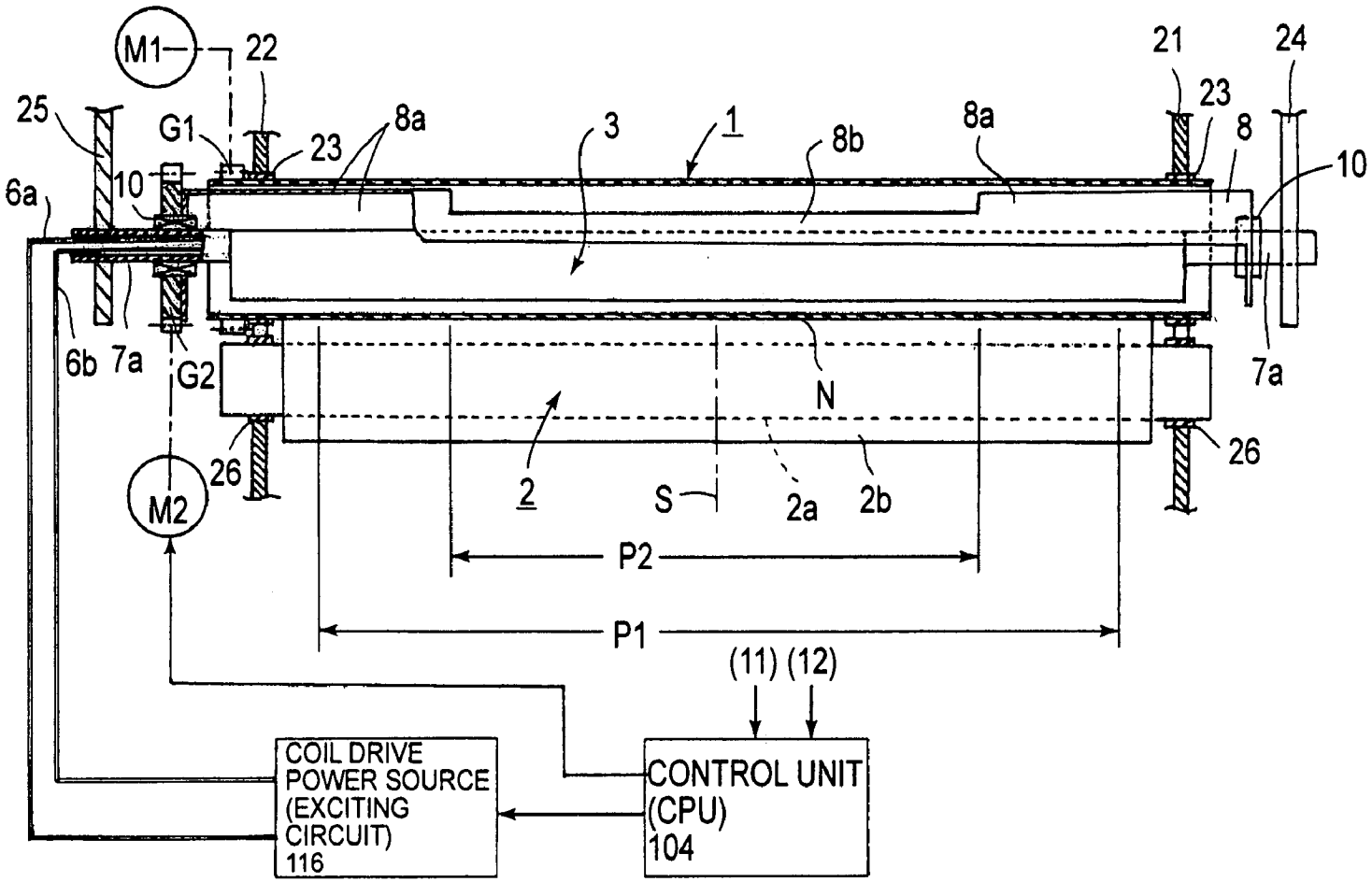
FIG. 4 is a longitudinal front view of the principal part.

FIG. 2 is an enlarged cross-sectional view of a principal portion of the fixing apparatus 114 as the heating apparatus according to the present invention, FIG. 3 is a front view of the principal portion, and FIG. 4 is a longitudinal front view of the principal portion.

This fixing apparatus 114 is of a heating roller type and is a heating apparatus of an electromagnetic induction heating type. The fixing apparatus 114 principally includes a pair of heating roller 1 (as a heating member (medium) or a fixing member) and a pressure roller 2 (as a pressure member) which are vertically disposed in parallel and pressed against each other at a predetermined pressing force to create a fixation nip portion N having a predetermined nip length (nip width).

The heating roller (hereinafter referred to as a "fixation roller") 1 is a roller having a hollow (cylindrical) metal layer (electroconductive layer) which is formed with an induction heating element (electromagnetic member or more metal), such as nickel or SUS 430 in a thickness of about 0.1–1.5 mm. At an outer peripheral surface of the roller, a heat-resistant release layer (heat conduction material) 1*a* is formed by coating the roller with a fluorine-containing resin etc.

The fixation roller 1 is rotatably supported between side plates (fixing unit frames) 21 and 22 (Located on the front and rear sides of the fixing apparatus) each via a bearing 23 at both end portions thereof. Further, at an inner hollow portion of the fixation roller 1, a coil assembly 3, as a magnetic flux generation means, which generates a high-frequency magnetic field by inducing an induction current (eddy current) in the fixation roller 1 to cause Joule heat, is injected and disposed.

The pressure roller 2 is an elastic roller including a core shaft 2*a*, and a silicone rubber layer 2*b*, as a heat-resistant rubber layer with a surface releasability, which is integrally and concentrically wound around the core shaft 2. The pressure roller 2 is disposed under and in parallel with the fixation roller 1 and is rotatably held between the side plates 21 and 22 (located on the front and near sides of the fixing apparatus) each via a bearing 26 at both end portions thereof. The pressure roller 2 is further pressed against the lower surface of the fixation roller 1 by an unshown bias means while resisting an elasticity of the elastic layer 2*b*, thus forming the fixation nip portion N having the predetermined nip length.

The coil assembly 3, as the magnetic flux generation means, inserted into the inner hollow portion of the fixation roller 1 is an assembly of a bobbin 4, a core (material) 5 comprising a magnetic material, an induction coil (exciting coil or induction heat source) 6, and a stay 7 formed with an insulating member. The core 5 is inserted into a through hole provided in the bobbin 4, and the induction coil 6 is constituted by winding a copper wire around the periphery of the bobbin. A unit of the bobbin 4, the core 5, and the induction coil 6 is fixedly supported by the stay 7. The coil is wound at a part of the circumference of the heating element and along the rotation axis of the roller so as to-heat part of the circumference of the heating element.

The magnetic flux blocking member 8 as a magnetic flux decreasing means is rotatably supported by a round shank-shaped portion 7*a* via a bearing 10 at each of both longitudinal end portions of the stay 7. In other words, the magnetic flux blocking member 8 is disposed to permit opening and shutting action.

As described above, the coil assembly 3 to which the magnetic flux blocking plate 8 is assembled is inserted into the inner hollow portion of the fixation roller 1 to be placed in a position with a predetermined angle and in such a state it holds a certain gap between the fixation roller 1 and the induction coil 6, so that the stay 7 is fixedly supported in a non-rotation manner by holding members 24 and 25 at both end portions thereof which are located on the front and rear sides of the fixing apparatus. The unit of the bobbin 4, the core 5, and the induction coil 6 is accommodated in the fixation roller 1 so as not to be protruded from the fixation roller 1.

As the core 5, a material which has a high permeability and small self-field loss may preferably be used. Examples thereof may suitably include ferrite, permalloy, sendust, etc. The bobbin 4 also functions as an insulating portion for insulating the core 5 from the induction coil 6.

The induction coil 6 is required to generate a sufficient alternating magnetic flux for heating, so that it is necessary to provide a low resistance component and a high inductance component. As a core wire of the induction coil 6, a litz wire comprising a bundle of about 80–160 fine wires having a diameter of 0.1–0.3 mm. The fine wires comprise an insulating electric cable. The fine wires are wound around the magnetic core plural times along the shape of the bobbin 4 in an elongated board form, thus providing the induction coil 6. The induction coil 6 is wound in a longitudinal direction of the fixation roller 1 and is provided with two lead wires (coil supply wires) 6*a* and 6*b* which are led from a hollow portion provided in the rear-side round shank-shaped portion 7*a*, as a hollow axis, of the stay 7 for supplying a high-frequency current to the induction coil 6 and is connected to a coil drive power source (exciting circuit) 116.

The fixation roller 1 has a first thermistor 11 and a second thermistor, as a temperature detection means, which are described later.

A separation claw 13 functions as a mean for separating the recording material P from the fixation roller 1 by suppressing winding of the recording material P, which is introduced into and passed through the fixing nip portion N, around the fixation roller 1.

The above described bobbin 4, the stay 7, and the separation claw 14 are formed of heat-resistant and electrically insulating engineering plastics.

A fixation roller drive gear G1 is fixed at the rear-side end portion of the fixation roller 1, and a rotational force is transmitted from a drive source M1 through a transmission system, whereby the fixation roller 1 is rotationally driven in a clockwise direction indicated by an arrow A at a predetermined peripheral speed. The pressure roller 2 is rotated in a counterclockwise direction indicated by an arrow B by the rotational drive of the fixation roller 1.

A magnetic flux blocking plate drive gear G2 is fixed at the rear-side end portion of the magnetic flux blocking plate 8, as a magnetic flux decreasing member. To the driving gear G2, a rotational force is transmitted from a drive source M2 through a transmission system, whereby the magnetic flux blocking plate is rotated around the coil assembly 3, as the magnetic flux generation means, which is the assembly of the bobbin 4, the core 5, the induction coil 6, the stay 7, etc., with the rear-side and front-side round shank-shaped portions 7*a* of the stay as the center. Thus, the magnetic flux blocking plate 8 is positionally controlled to effect opening and shutting action on the coil assembly 3.

A fixation roller cleaner 14 includes a cleaning web 14*a* as a cleaning member, a web feeding axis portion 14*b* which holds the cleaning web 14*a* in a roll shape, a web take-up axis portion 14*c*, and a pressing roller 14*d* for pressing the web portion between the both axis portions 14*b* and 14*c* against the outer surface of the fixation roller 1. By the web portion pressed against the fixation roller 1 by use of the pressing roller 14*d*, offset toner on the fixation roller 1 surface is wiped out to clean the fixation roller 1 surface. The web portion pressed against the fixation roller 1 is gradually renewed by feeding the web 14*a* little by little from the feeding portion 14*b* to the take-up portion 14*c*.

A thermostat 15 is disposed on the fixation roller 1 as a safeguard mechanism at the time of abnormal rise in temperature of the fixation roller (thermal runaway). The thermostat 15 contacts the surface of the fixation roller 1 and shuts off energization of the induction coil 6 by releasing a contact when the temperature becomes a preliminarily set temperature, thus preventing the fixation roller 1 from being heated up to a temperature exceeding a predetermined temperature.

IN this embodiment, sheet passing (feeding) is performed on the basis of a center S. In other words, all the recording materials of any sizes pass through the fixation roller in such a state that the center portion of the recording materials passes along the center portion in the roller axis direction of the fixation roller. In the image forming apparatus of this embodiment, a maximum size of the recording material which can be passed through the fixation roller (such a recording material is referred to as a "large-sized sheet (paper)") is A4 (landscape), and a minimum size of the recording material which can be passed through the fixation roller (Such a recording material is referred to as a "small-sized sheet (paper)") is B5R. P1 represents a sheet passing area width of the large-sized sheet, and R2 represents a sheet passing area width of the small-sized sheet.

The above described first thermistor 11 is disposed, as a center portion temperature detection apparatus, opposite to the induction coil 6 via the fixation roller 1 at the fixation roller center portion corresponding to approximately the center portion of the sheet passing area width P2 of the small-sized sheet while being elastically pressed against the surface of the fixation roller 1 by an elastic member.

The second thermistor 12 is disposed and elastically pressed against the surface of the fixation roller 1 in a fixation roller end portion corresponding to a differential area, between the sheet passing area width P1 of the large-sized sheet and the sheet passing area width P2 of the small-sized sheet, in which temperature rise at the non-sheet passing portion is caused to occur.

Temperature detection signals of the fixation roller temperature by the first and second thermistors 11 and 12 are inputted into the controller (CPU) 104.

Figure 5:
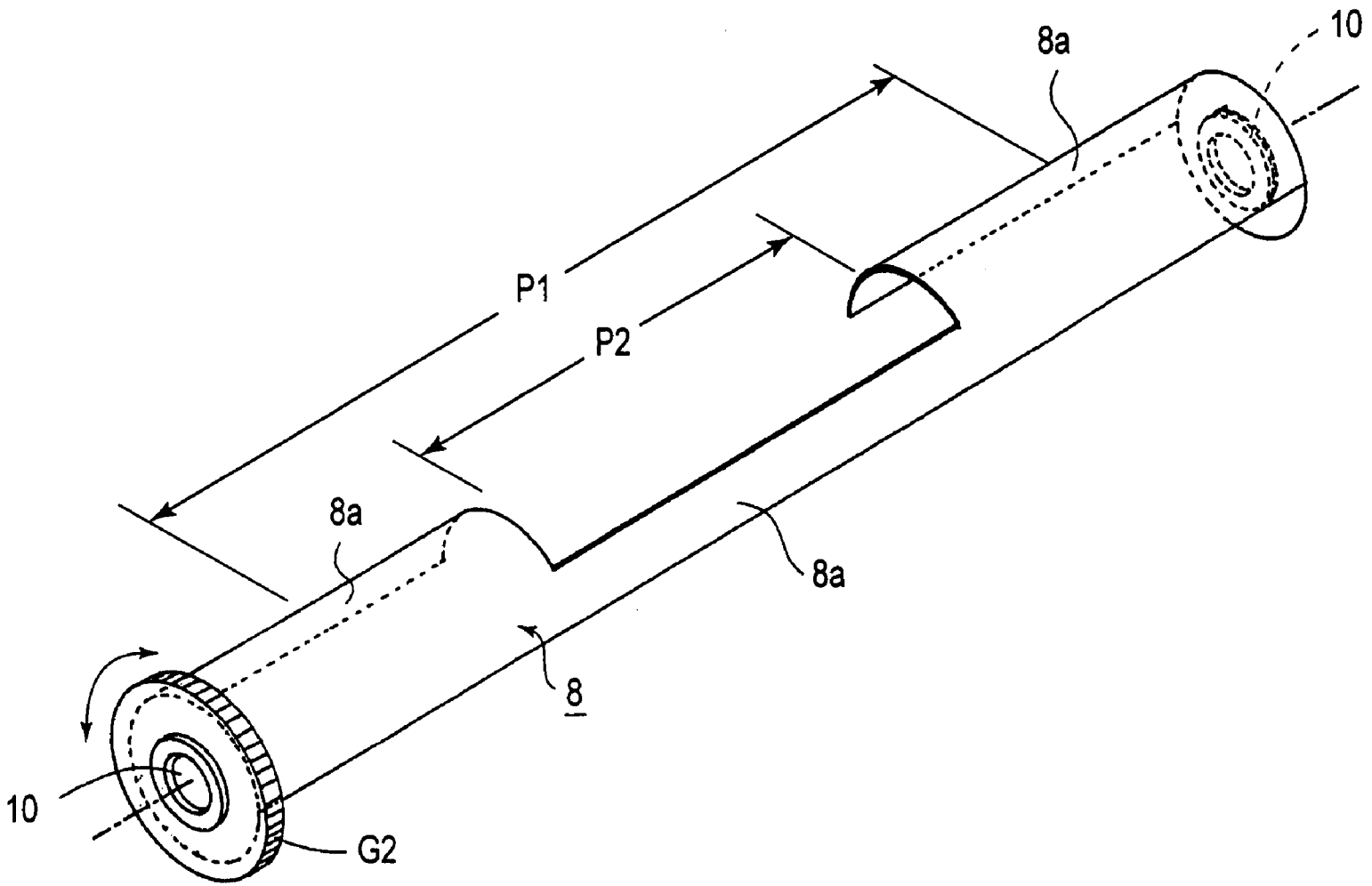
FIG. 5 is an external perspective view of a magnetic field blocking plate used in First Embodiment.

FIG. 5 is an external perspective view of the magnetic flux blocking plate 8.

The magnetic flux blocking plate 8 is an end portion abnormal temperature rise prevention member and is as described later, a means for maintaining the temperature of the fixation roller 1 in a certain range in the entire area through which the recording material passes. The magnetic flux blocking plate 8 is formed of nonmagnetic and good electroconductive material such as alloys containing aluminum, copper, magnesium, silver, etc., and includes almost semicircular wide blocking plate portions (shutter plate portions) 8*a* and 8*a* located at both longitudinal end portions thereof and a narrower connecting plate portion 8*b* located between the wide blocking plate portions 8*a* and 8*a*. The magnetic flux blocking plate 8 is approximately 180-degree inversion-driven reciprocally around the assembly of the bobbin 4, the core 5, the induction coil 6, and the stay 7 with the rear-side and front-side round shank-shaped portions 7*a* of the stay 7 as a center. As a result, the magnetic flux blocking plate 8 is displacement-controlled between a first rotation angle position corresponding to the upper semicircular portion, in the fixation roller 1, indicated by a solid line shown in FIG. 2 and a second rotation angle position corresponding to the lower semicircular portion, in the fixation roller 1, indicated by a chain double dashed line shown in FIG. 2.

In the first rotation angle position of the magnetic flux blocking plate 8, the magnetic flux blocking plate 8 is disposed away from the gap between the inner surface of the fixation roller 1 and the induction coil 6 and is referred to as a blocking plate OFF position (an opening operation position with respect to the magnetic flux generation means). The magnetic flux blocking plate 8 is held in this blocking plate OFF position as a home position in normal times.

On the other hand, in the second rotation angle position of the magnetic flux blocking plate 8, the wide blocking plate portions (shutters) 8*a* enter and are located in the gap between the inner surface of the fixation roller 1 and the induction coil 6, thus being placed in such a state that the wide blocking plate portions 8*a* enter and are located at a winding center position in the gap between the fixation roller 1 and the heating area-side induction coil portion, of the inner surface portion of the fixation roller, corresponding to the differential area causing the non-sheet passing portion temperature rise between the large-sized and small-sized sheet passing area widths P1 and P2. The second rotation angle position of the magnetic flux blocking plate 8 is referred to as a blocking plate ON position (a closing operation position).

When the shutters 8*a* are caused to enter the gap between the fixation roller inner surface portion and the induction coil portion, it is possible to provide the shutters 8*a* with a guide function by causing the shutters 8*a* to enter (or slide) in contact with the bobbin 4 as the coil holding means. By doing so, it is possible to prevent vibration of the shutters and reduce the contact of the shutters with the heating element.

The controller 104 of the image forming apparatus starts a predetermined image forming sequence control by actuating the apparatus through power-on of a main switch of the apparatus. The fixing apparatus 114 is driven by actuating the drive source M1 to start rotation of the fixation roller 1. By the rotation of the fixation roller 1, the pressure roller 2 is also rotated. Further, the controller 104 actuates a coil actuating power source 116 to pass a high-frequency current (e.g., 10 kHz to 500 kHz) through the induction coil 6. As a result, high-frequency alternating magnetic flux is generated around the induction coil 6, whereby the fixation roller 1 is heated, through electromagnetic induction, toward a predetermined fixation temperature (200° C. in this embodiment). This temperature rise of the fixation roller 1 is detected by the first and second thermistors 11 and 12, and detected temperature information is inputted into the controller 104.

The controller 104 controls the power supplied from the coil actuating power source 116 to the induction coil 6 so that the detected temperature, of the fixation roller 1, which is inputted from the first thermistor 11 as a temperature detection means for temperature control is kept at the predetermined fixation temperature of 200° C., thus performing temperature rise of the fixation roller 1 and temperature control (heat regulation) at the fixation temperature of 200° C. In this case, the magnetic flux blocking plate 8 is displace din this blocking plate OFF position (the first rotation angle position) in normal times, so that the fixation roller 1 is heated to the fixation temperature of 200° C. in the entire are with the large-sized sheet passing area width P1, thus being temperature-controlled. Then, in the temperature-controlled state, the recording material P, as a material to be heated, carrying thereon an unfixed toner image t is introduced from the image formation side into the fixing nip portion N. The recording material P is sandwiched and conveyed between the fixation roller 1 and the pressure roller 2 in the nip portion N, whereby the unfixed toner image t is heat-fixed on the surface of the recording material P under heat by the fixation roller 1 and pressing force at the nip portion N.

In the case where the recording material P to be passed through the nip portion N is the small-sized sheet, as described above, the differential area between the large-sized sheet passing area width P1 and the small-sized sheet passing area width P2 at the fixing nip portion N is the non-sheet passing area. When the small-sized sheet is passed continuously through the nip portion N, the temperature at the fixation roller portion corresponding to the small-size sheet passing area width P2 (sheet passing area) is temperature-controlled and kept at the fixation temperature of 200° C. but the temperature at the fixation roller portion corresponding to the non-sheet passing area is increased over the fixation temperature of 200° C. (non-sheet passing portion temperature rise) because heat the fixation roller portion is not consumed for heating the recording material or the toner image.

The second thermistor 12 detects the temperature of the fixation roller portion corresponding to the non-sheet passing portion area, as a temperature detection means for monitoring temperature control abnormality of the fixation roller 1, and detected temperature information is inputted into the controller 104. The controller 104 controls the drive source M2 on the basis of the detected temperature information to displace the magnetic flux blocking plate 8 to the blocking plate ON position or the blocking plate OFF position, whereby the fixation roller temperature is kept in the predetermined range in the entire sheet passing area for the recording material on the fixation roller 1.

In this embodiment, a heat-resistive temperature of the induction coil 6 is 230° C. and a low-temperature offset temperature derived from the pressing force and the nip length (width) at the nip portion N is 170° C. Accordingly, the controller 104 controls the drive power source M2 on the basis of the detected temperature information inputted from the second thermistor 12 so that the temperature in the entire sheet passing area P1 of the fixation roller 1 is the temperature range from 170° C. to 230° C. even in the case of passing continuously the small-sized sheet, whereby the position of the magnetic flux blocking plate 8 is changed to the ON position or the OFF position.

More specifically, in this embodiment, when the detection temperature of the second thermistor 12 exceeds 220° C., the drive power source M2 is controlled by the controller 104 so as to change the position of the magnetic flux blocking plate 8 to the ON position, whereby the wide blocking plate portions 8*a* enter the gap between the inner surface of the fixation roller 1 and the induction coil and are located in an area corresponding to the non-sheet passing area. As a result, working magnetic flux, from the induction coil 6, acting on the fixation roller portion (area) is blocked, whereby electromagnetic induction heating at the fixation roller portion (area) corresponding to the non-sheet passing area is removed to decrease the temperature of the fixation roller portion (area) corresponding to the non-sheet passing area. This temperature decrease state is also monitored by the second thermistor 12. When the detection temperature of the second thermistor 12 is lower than 180° C., the drive power source M2 is controlled by the controller 104 so as to change the position of the magnetic flux blocking plate 8 to the OFF position, whereby the wide blocking plate portions 8*a* which have entered the gap between the inner surface of the fixation roller 1 and the induction coil and have been located in an area corresponding to the non-sheet passing area, is moved outside the gap. As a result, working magnetic flux from the induction coil 6 again acts on the fixation roller portion (area) corresponding to the non-sheet passing area, whereby electromagnetic induction heating at the fixation roller portion (area) corresponding to the non-sheet passing area is resumed to increase the temperature of the fixation roller portion (area) corresponding to the non-sheet passing area.

In the above operations, a movement temperature for moving the magnetic flux blocking plate 8 to an effective position for temperature decrease may preferably have a temperature range of not less than 5° C., desirably not less than 10° C. As a result, the number of driving operation can be reduced, thus alleviating a deterioration of the drive gears.

Figure 6:
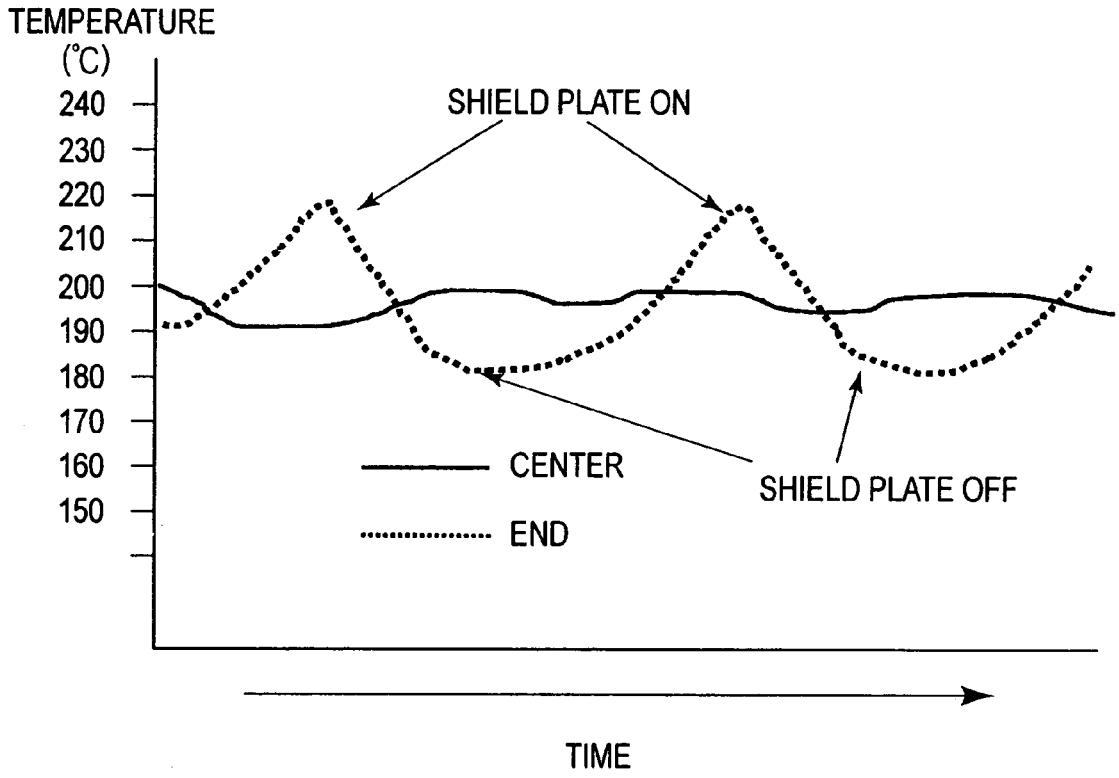
FIG. 6 is a graph showing a temperature gradient of a fixation roller used in First Embodiment.

FIG. 6 is a graph showing a temperature gradient at a central portion and an end portion of the fixation roller in the case where the above described control is performed by passing the small-sized sheet (B5R) through the nip portion N.

In FIG. 6, a solid line represents a temperature at the central portion of the fixation roller corresponding to a small-sized sheet passing area, and a dotted line represents a temperature at the end portion of the fixation roller corresponding to a non-sheet passing area of the small-sized sheet. Even when the small-sized sheet is continuously passed through the nip portion N, as shown in FIG. 6, the fixation roller 1 can maintain its temperature in the range of 170–230° C. in the entire sheet passing area. As a result, it is possible to not only perform continuous sheet passing operation of the small-sized sheet without lowering productivity but also permit good image fixation even when the large-sized sheet is passed through the nip portion N immediately after the continuous small-sized sheet passing operation.

In this embodiment, the ON-OFF positional change control of the magnetic flux blocking plate 8 by the controller 4 may also be performed on the basis of a difference between temperatures detected by the first and second thermistors 11 and 12.

Further, in this embodiment, the shutter is moved in the ON position (for lowering the temperature of the fixation roller at the non-sheet passing portion) through the detection of the non-sheet passing portion temperature but may also be moved in the ON position by judging that the small-sized sheet is conveyed by detecting, e.g., the size of the recording material.

In this embodiment, the non-sheet passing portion temperature is lowered by blocking magnetic flux in an area corresponding to the non-sheet passing portion by use of the magnetic flux blocking plate 8 but can also be decreased relative to the sheet passing portion temperature in such a manner that, e.g., a heat generating rate at the small-sized sheet passing portion is set to be higher than that at the non-sheet passing portion, and the shutter is positioned or moved in position, when magnetic flux corresponding to the small-sized sheet passing area is reduced, to uniformize the temperature of the heating element in the longitudinal direction in the case of passing an ordinary large-sized sheet and is positioned or moved in a position, where magnetic flux corresponding to the small-sized sheet passing area is not reduced, to lower the temperature of the non-sheet passing portion than that of the sheet passing portion.

Further, the present invention is applicable during heating of the coil which is energized (during a period in which the coil is temperature-controlled at a predetermined temperature by a temperature control means for adjusting the roller temperature), so that it is possible to prevent the temperature of the heating element to locally decrease.

(Other Embodiments)

1) The heating apparatus of the electromagnetic induction heating type according to the present invention is not limited to be used as the image heat-fixing apparatus as in the above described embodiment but is also effective as a provisional fixing apparatus for provisionally fixing an unfixed image on a recording sheet or an image heating apparatus such as a surface modification apparatus for modifying an image surface characteristic such as glass by reheating a recording sheet carrying thereon a fixed image. In addition, the heating apparatus of the present invention is also effective as a heating apparatus for heat-treating a sheet-like member, such as a hot press apparatus for removing rumples of bills or the like, a hot laminating apparatus, or a hot-drying apparatus for evaporating a moisture content of paper or the like.

2) The shape of the heating member is not limited to the roller shape but may be other rotational body shapes, such as an endless belt shape. The heating member may be constituted by not only a single induction heating member or a multilayer member having two or more layers including an induction heating layer and other material layers of heat-resistant plastics, ceramics, etc.

3) The induction heating scheme of the induction heating member (element) by the magnetic flux generation means is not limited to the internal heating scheme but may be an external heating scheme in which the magnetic flux generation means is disposed outside the induction heating member.

4) The temperature detection means 11, 12 and 19 are not limited to the thermistor may be any temperature detection element of a contact type or a non-contact type.

5). The heating apparatus of the present invention has such a mechanism for conveying the material to be heated (recording material) on the center basis but may be effectively applied as such an apparatus having a mechanism for conveying the material on one side basis.

6) Further, the heating apparatus of the present invention has such a structure that the large-and small-sized (two kinds of) materials (sheets) to be heated (recording materials) but is applicable to an apparatus by which three or more kinds of sizes are subjected to sheet feeding or passing.

While the invention has been described with reference to the structures disclosed herein, it is not confined to the details set forth and this application is intended to cover such modifications or changes as may come within the purposes of the improvements or the scope of the following claims.

This application claims priority from Japanese Patent Application No. 430232/2003 filed Dec. 25, 2003, which is hereby incorporated by reference.

What is claimed is:

1. An image heating apparatus, comprising:

a coil for generating magnetic flux by energization;

an image heating member which generates heat by the magnetic flux and heats an image on a recording material;

a magnetic flux adjusting member for adjusting magnetic flux toward said image heating member;

energization control means for controlling energization to said coil so that a temperature of said image heating member is an image heating temperature for heating the image;

moving means for moving said magnetic flux adjusting member to an adjusting position at which magnetic flux toward an end portion of said image heating member is less than magnetic flux toward a central portion of said image heating member and to a retracted position different from said adjusting position; and movement control means, comprising a first temperature detection member for detecting a temperature at the end portion of said image heating member, for retracting said magnetic flux adjusting member from said adjusting position at a first setting temperature lower than said image heating temperature.

2. An apparatus according to claim 1, wherein said movement control means moves said magnetic flux adjusting member from said retracted position to said adjusting position at a second setting temperature higher than said image heating temperature during continuous passing of a recording material having a small width in a direction perpendicular to a conveyance direction of the recording material.

3. An apparatus according to claim 2, wherein the first setting temperature and the second setting temperature provide a difference in temperature of not less than 10° C.

4. An apparatus according to claim 2, wherein the second setting temperature is lower than a heat resistant temperature if said coil.

5. An apparatus according to claim 1, wherein the first temperature detection member is disposed outside an area through which a minimum width recording material is to be passed in a direction perpendicular to a conveyance direction of the recording material and disposed within an area through which a maximum width recording material is to be passed in the direction perpendicular to the conveyance direction.

6. An apparatus according to claim 1, wherein said image heating apparatus further comprises a second temperature detection member, disposed within an area through which a minimum width recording material is passed in a direction perpendicular to a conveyance direction of the recording material, for detecting a temperature of said image heating member and wherein said energization control means is controlled on the basis of an output of said second temperature detection member.

7. An apparatus according to claim 1, wherein said magnetic flux adjusting member comprises an electroconductive plate which is disposed inside said image heating member and moved between said coil and said image heating member.

* * * * *

UNITED STATES PATENT AND TRADEMARK OFFICE

CERTIFICATE OF CORRECTION

PATENT NO. : 7,132,631 B2
APPLICATION NO. : 11/016874
DATED : November 7, 2006
INVENTOR(S) : Yasuo Nami et al.

It is certified that error appears in the above-identified patent and that said Letters Patent is hereby corrected as shown below:

ON THE TITLE PAGE:
At Item (56), Title, “FLEXING” should read --FIXING--.

COLUMN 1:
Line 1, “FLEXING” should read --FIXING--.
Line 21, “in” should read --in a--.
Line 64, “lower” should read --lowering--.

COLUMN 3:
Line 7, “late” should read --plate--.
Line 16, “computer” should read --computer,--.

COLUMN 4:
Line 8, “Apparatus 114.” should read --Apparatus 114--.
Line 30, “resin” should read --resin,--.
Line 33, “(Located” should read --(located--.
Line 47, “near” should read --rear--.
Line 66, “to-heat” should read --to heat--.

COLUMN 5:
Line 43, “mean” should read --means--.

COLUMN 6:
Line 25, “IN” should read --In--.
Line 40, “above described” should read --above-described--.

COLUMN 8:
Line 6, “displace din” should read --displaced in--.
Line 9, “are” should read --area--.
Line 33, “heat the” should read --the heat--.

COLUMN 9:
Line 29, “operation” should read --operations--.
Line 34, “above described” should read --above-described--.

UNITED STATES PATENT AND TRADEMARK OFFICE

CERTIFICATE OF CORRECTION

PATENT NO. : 7,132,631 B2
APPLICATION NO. : 11/016874
DATED : November 7, 2006
INVENTOR(S) : Yasuo Nami et al.

It is certified that error appears in the above-identified patent and that said Letters Patent is hereby corrected as shown below:

COLUMN 10:
Line 24, “above” should read --above- --.
Line 41, “or” should read --but also--.
Line 51, “are not” should read --that are not--.
Line 54, “5). The” should read --5) The--.
Line 60, “large-and” should read --large- and--.

COLUMN 12:
Line 9, “if” should read --of- --.

Signed and Sealed this

Tenth Day of July, 2007

JON W. DUDAS
*Director of the United States Patent and Trademark Office*